United States Patent [19]

Hesterberg et al.

[11] Patent Number: 4,858,671

[45] Date of Patent: Aug. 22, 1989

[54] METHOD AND APPARATUS FOR ACCELERATING METAL SOLIDIFICATION

[75] Inventors: William G. Hesterberg, Rosendale; Terrance M. Cleary, Allenton, both of Wis.

[73] Assignee: Brunswick Corporation, Skokie, Ill.

[21] Appl. No.: 183,622

[22] Filed: Apr. 19, 1988

[51] Int. Cl.[4] ..... B22C 9/04; B22D 27/04

[52] U.S. Cl. ..... 164/34; 164/122; 164/127; 164/348; 164/352; 164/412

[58] Field of Search ..... 164/122, 125, 127, 348, 164/352, 355, 371, 412, 34

[56] References Cited

U.S. PATENT DOCUMENTS 3,658,116 4/1972 Hunt ..... 164/485 X

FOREIGN PATENT DOCUMENTS 57-85642 5/1982 Japan ..... 164/122

194274 5/1967 U.S.S.R. ..... 164/127

*Primary Examiner*—Nicholas P. Godici

*Assistant Examiner*—J. Reed Batten, Jr.

*Attorney, Agent, or Firm*—Andrus, Sceales, Starke & Sawall

[57] ABSTRACT

Molten metal is poured in an open top basin that communicates via a sprue with a cavity or expendable pattern in a mold to fill the cavity and partially fill the basin. After the casting metal has solidified through the gating that connects the sprue to the cavity, a tapered heat transfer member is introduced into the molten metal in the basin. A cooling medium is passed through the heat transfer member to extract heat from the metal in the basin and correspondingly cool the metal casting, thereby decreasing the cooling period prior to shakeout.

15 Claims, 1 Drawing Sheet

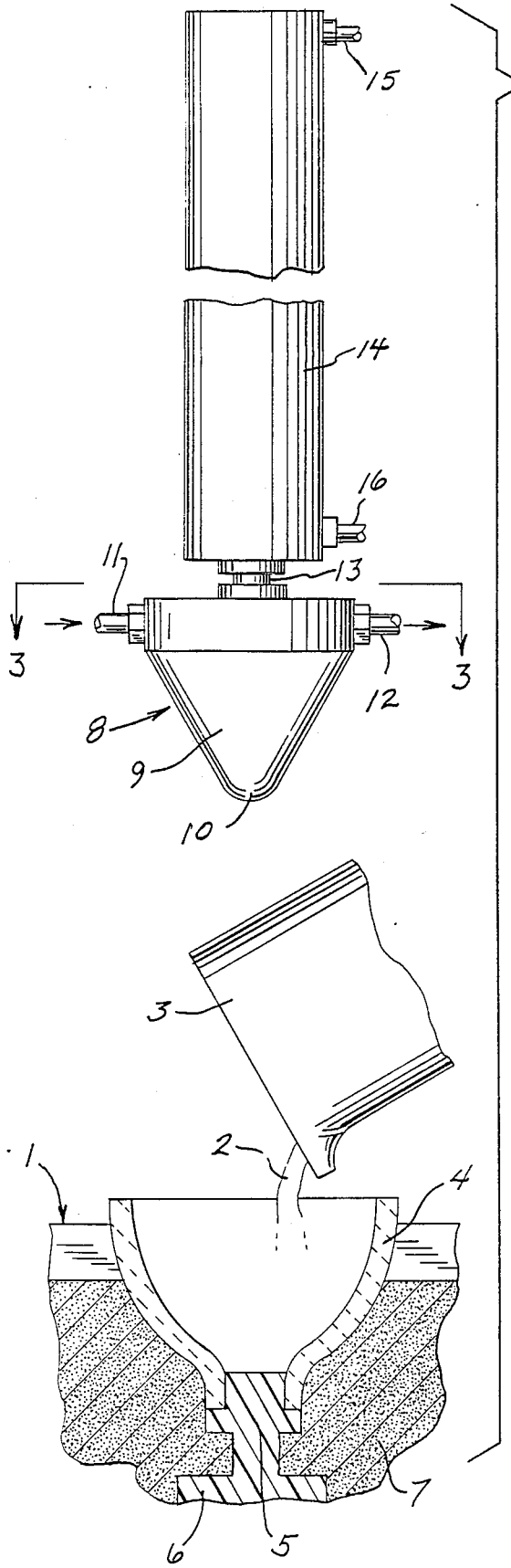
FIG. 1
FIG. 2
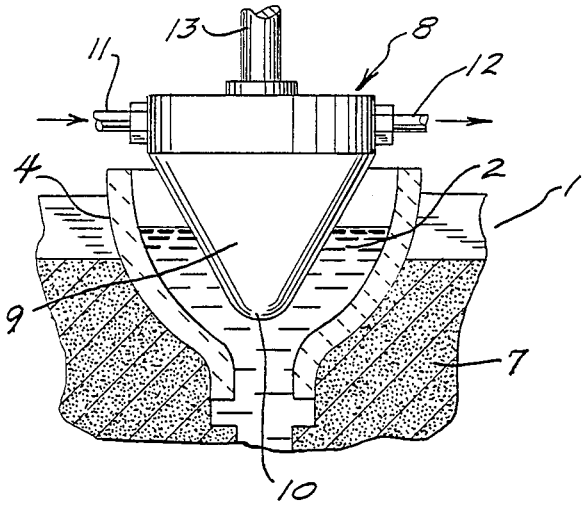
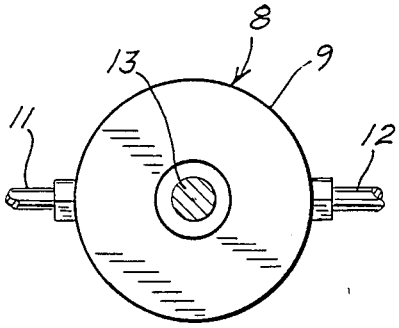
FIG. 3

METHOD AND APPARATUS FOR ACCELERATING METAL SOLIDIFICATION

BACKGROUND TO THE INVENTION

In production casting of metal parts, such as cylinder blocks for internal combustion engines or other cast components, a series of molds are positioned on a conveyor system and sequentially conveyed to a pouring station where molten metal is poured into an open top basin that is connected to the cavity or expendable pattern in the mold. The basin serves as an accumulator to provide a reservoir of molten metal, so that a continuous supply of molten metal is available to the mold cavity or expendable pattern.

After pouring, the mold is transferred on a conveyor system and begins cooling until the metal reaches a temperature where it can be removed from the mold. Molten aluminum alloys are generally cast at a temperature of about 1300° F., and it is necessary to cool the casting to a temperature near the range of 700° F. to 800° F., depending on the configuration of the casting, before the casting can be removed from the mold. In commercial practice, it is a distinct advantage to reduce the cooling time because it speeds the production cycle and reduces the overall size of the required conveying system.

SUMMARY OF THE INVENTION

The invention is directed to a method and apparatus for accelerating solidification of a molten material, such as molten metal, in a casting pouring basin. In accordance with the invention, molten metal is poured into a open top basin, which is connected via a sprue to a cavity or expendable pattern in a mold and the molten metal fills the cavity and partially fills the basin. After the molten metal has solidified from the coldest part of the casting (farthest distance from the pouring basin along the metal feed path) through the gating that connects the sprue with the mold cavity, a heat transfer member is inserted into the molten metal in the basin.

The heat transfer member is tapered downwardly, having a bullet-like shape, and is formed of a material having a high coefficient of thermal conductivity, such as cooper or copper based alloys, and which is compatible with the harsh environment involved.

A cooling medium, such as water or air, can be circulated through the heat transfer member and heat is transferred from the molten, partially solidified or solidified metal to the cooling medium to thereby substantially reduce the time for cooling the casting to a temperature where the casting can be removed from the mold.

The method of the invention permits rapid cooling of the cast molten metal in the pouring basin, which acts to cool the overall casting, and reduces the time normally required for conventional ambient cooling prior to shakeout.

The invention also reduces the overall size of the conveying system, requiring a shorter distance between the pouring station and the casting extraction station, thereby reducing floor space, capital equipment and in-process inventory associated with poured molds.

The reduced time between pouring and extraction of the casting provides an earlier inspection opportunity for the castings to verify molding and pouring practices and enables corrective action, if necessary, to minimize or eliminate quality related problems.

Extraction of a cool casting minimizes the need for further cooling and increases the strength of the casting to reduce handling damage and distortion often associated with extraction stresses.

As a further advantage, the rapid cooling of the pouring basin metal and the associated cooling of the sprue allows early extraction of the comparatively cold solid sprue and pouring basin metal from the casting, thereby permitting severing the rigging from the casting during extraction. The casting can thus be degated without the need for conventional labor intensive practices, as used in the past.

The tapered heat transfer member provides a high surface contact area with he molten metal in the basin and yet permits the heat transfer member to be readily withdrawn from the molten metal. In certain applications, the heat transfer member is not withdrawn until the molten metal in the basin has solidified, thereby resulting in a depression or reverse image being formed in the solidified metal of the basin. This reverse image can be used to receive a tapered heat transfer member at a location downstream from the original contact site in order to further expedite cooling after the metal in the pouring basin has solidified, and for positive location of the casting for fixturing and further processing.

Other objects and advantages will appear in the course of the following description:

DESCRIPTION OF THE DRAWINGS

The drawings illustrate the best mode presently contemplated of carrying out the invention.

FIG. 1 is a side elevation with parts broken away in section of the apparatus of the invention.

FIG. 2 is a view similar to FIG. 1 showing the heat transfer member immersed in the molten metal of the basin, and FIG. 3 is a section taken along line 3—3 of FIG. 1.

DESCRIPTION OF THE ILLUSTRATED EMBODIMENT

The drawings illustrate an apparatus for accelerating the solidification of a cast metal part. The cast metal part can take the form of an engine component for an internal combustion engine or other desired article. As illustrated, the component is cast using an evaporable foam process which can be similar to that described in co-pending U.S. application Ser. No. 07/015,744, filed Feb. 17, 1987 and now U.S. Pat. No. 4,721,149 issued Jan. 26, 1988. While the invention is illustrated in connection with the lost foam casting process, it is apparent that the invention can also be used with equal results in other casting methods, such as green sand, bonded sand, semi-permanent mold and investment casting.

As shown in FIG. 1, the apparatus includes a mold 1 and molten metal 2 is poured from a ladle 3 into an open top basin 4 which communicates with an evaporable foam inlet member 5, made of polystyrene or the like. Inlet member 5 is located within the lower narrow neck of the basin 4 and the lower end of the inlet member 5 is connected to an evaporable form sprue 6, which in turn is connected through gating to a pattern, not shown, that is located within the mold. An unbonded flowable material such as sand 7, surrounds the member 5, sprue 6 and the pattern. During the casting operation, the heat of the molten metal will vaporize the foam material with the vapor being distributed within the voids in the sand 7, while the molten material will fill the void caused by the evaporation of the foam material to provide a cast metal part that is identical in shape with the foam pattern.

Basin 4 acts an accumulator to provide a continuous supply of the molten metal to the mold cavity and after the mold cavity has been filled, the molten metal will at least partially fill the basin 4. After the cast part has solidified through the gating, a heat transfer unit 8 is introduced into the molten metal in basin 4 to draw heat from the molten metal and reduce the overall time for cooling of the casting to a temperature where it can be extracted from the mold. Heat transfer unit 8 includes a housing 9 that is tapered downwardly to provide a generally bullet-like shape, terminating in a generally rounded tip 10. Heat transfer unit 8 is formed of a metal having a high coefficient of thermal conductivity, such as copper or a copper base alloy, and the metal should have high shock resistance and be capable of withstanding repeated cyclic exposure to repeated temperature fluctuations as occurs when the heat transfer unit contacts the molten, partially molten, or solidified metal in basin 4.

A cooling medium, such as water or air, is introduced into the hollow interior of housing 9 through an inlet conduit 11 and is withdrawn from the housing through an outlet conduit 12.

The heat transfer unit 8 is moved in a reciprocating path by a fluid cylinder unit, as best shown in FIG. 1. A piston rod 13 is connected to the upper end of housing 9 and carries a piston which is slidable within cylinder 14. To extend the piston rod 13 and move housing 9 into basin 4, fluid is introduced into the upper end of cylinder 14 through conduit 15, while introducing fluid into the lower end of cylinder 14 through conduit 16 will retract the piston rod 13 and withdraw housing 9 from basin 4.

In operation, mold 1 is conveyed on a conveyor, not shown, to the pouring station, and the molten metal 2, from ladle 3 is then poured into the basin 4 to fill the mold cavity and partially fill the basin. After pouring, the mold is advanced along the conveyor path and allowed to cool until the cast metal has solidified through the gating. At this time, heat transfer unit 8 is lowered by operation of cylinder 14 to partially immerse the housing 9 in the molten metal contained in basin 4, as illustrated in FIG. 2. With a cooling medium flowing within the housing 9, heat will be transferred from the molten metal to the cooling medium and the rapid cooling of the cast molten metal in the pouring basin will cool the overall casting and thereby reduce the time normally required prior to shakeout of the casting.

Heat transfer unit 8 can either be elevated while the metal in basin 4 is still molten, or alternately, after the metal has solidified. In the latter situation, a depression, which constitutes a reverse image of housing 9 will be formed in the metal in basin 4, and this depression can serve as a locator during subsequent processing of the casting.

In practice, when casting engine block components using an aluminum alloy by a lost foam process, it has been found that under conventional ambient cooling and without the use of the heat transfer unit 8, the temperature at the base of the pouring basin 4 is reduced from 1300° F. to 750° F. in 52.3 minutes. In contrast, cooling under identical conditions but employing the heat transfer unit 8, reduced the cooling from 1300° F. to 750° F. to a period of 26.3 minutes, a reduction of 26.0 minutes.

The resulting shortened cooling period substantially reduces in-line processing time for the cast parts, as well as reducing capital equipment costs and in-process inventory of molds and associated equipment.

As the casting can be more quickly cooled to a lower temperature, the extraction of the cool casting reduces the need for further cooling and increases the strength of the casting to minimize possible damage during handling or shipment.

The tapered or bullet-like shape of the heat transfer housing 9 provides a large surface contact area with the molten metal in basin 4 and facilitates withdrawing of the housing from the base. At the temperatures involved, the molten metal will not weld nor adhere to the housing 9 as it is withdrawn.

The method of the invention has application to various alloys such as aluminum base alloys, zinc base alloys, ferrous alloys, copper base alloys, as well as non-metallic slurries that favorably respond to chilling or temperature control.

While the drawings illustrate a fluid cylinder 14 as the mechanism for actuating the heat transfer unit 8, it is contemplated that other mechanisms can be substituted.

The invention can be utilized in casting processes employing an expendable pattern, such as evaporable foam casting, where the mold contains an expendable pattern, or casting processes, such as green sand or permanent mold, where the mold contains a void or cavity. Thus, the term "metal receiving zone" as used in the claims is intended to cover a mold containing either an expendable pattern or a void or cavity.

Various modes of carrying out the invention are contemplated as being within the scope of the following claims, particularly pointing out and distinctly claiming the subject matter which is regarded as the invention.

We claim:

1. An apparatus for casting an article, comprising a mold defining a receiving zone, a non-metallic medium disposed within said mold and surrounding said zone, a basin for introducing molten material into said zone to form a cast article, heat transfer-means disposed to be moved into contact with said molten material in said basin for removing heat from said material and reducing the cooling time for said cast article, and means for flowing a cooling fluid through the heat transfer means.

2. The apparatus of claim 1, wherein said heat transfer means is tapered inwardly in a direction towards the basin.

3. The apparatus of claim 3, wherein said heat transfer means terminates in a generally rounded tip.

4. The apparatus of claim 1, wherein said basin includes an inner conduit connected to said zone and an outer open top receptacle having a larger cross-sectional area than said inner conduit.

5. The apparatus of claim 1, and including an evaporable foam pattern disposed in said zone and characterized by the ability to vaporize when exposed to the heat of said molten material.

6. An apparatus for casting a metal article, comprising a mold defining a metal receiving zone, a finely divided non-metallic material disposed within said mold and surrounding said zone, a basin communicating with said zone for receiving molten metal and feeding said molten metal to said zone to form a metal casting, a heat transfer member disposed in alignment with said basin, said heat exchange member being tapered radially inward in a direction toward said basin, means for moving the heat transfer member into the basin and into contact with the metal therein, and means for flowing a cooling fluid through the heat transfer member to remove heat from the metal in said basin and correspondingly cool and progressively solidify the casting in a downward direction.

7. The apparatus of claim 6, wherein said means for moving said heat transfer member comprises a fluid actuated cylinder unit.

8. The apparatus of claim 6, wherein said heat transfer member has a bullet-like shape.

9. An apparatus for casting a metal article, comprising a mold defining a metal receiving zone, a finely divided non-metallic medium disposed within said mold and surrounding said zone, a basin for introducing molten metal into said zone to form a cast metal article, an evaporable foam pattern disposed in said zone and characterized by the ability to vaporize when exposed to the heat of said molten metal, heat transfer means disposed to be moved into contact with the molten metal in said basin to thereby remove heat from said molten metal, and means for flowing a cooling fluid through said heat transfer means.

10. A method of casting, comprising the steps of forming a mold having a metal receiving zone and gating connecting said zone with a sprue, surrounding said zone with a non-metallic medium, connecting an open top pouring basin with said sprue, introducing a molten material into said basin to fill said zone and said gating with said material and at least partially fill said basin, inserting a heat transfer member having a relatively high coefficient of thermal conductivity into said basin and into contact with the molten material therein after the material has solidified in said zone and in said gating to thereby transfer heat from said material to said heat transfer member, and withdrawing said heat transfer member from said basin.

11. A method of casting a metal article, comprising the steps of forming a mold having a metal receiving zone and gating connecting said zone with a sprue, surrounding said zone with a finely divided non-metallic medium, connecting an open-top pouring basin with said sprue, introducing molten metal into the basin to fill said zone and said gating with said molten metal and at least partially fill said basin, inserting a heat transfer member into the basin and into contact with the molten metal therein to partially submerge said heat transfer member in the molten metal and thereby transfer heat from the molten metal to said heat transfer member, and flowing a cooling medium through the heat transfer member while said heat transfer member is partially submerged in said molten metal.

12. The method of claim 11 and including the step of forming said heat transfer member with an outer tapered configuration terminating in a general rounded tip facing towards said basin.

13. The method of claim 11, and including the step of withdrawing the heat transfer member from the basin while the metal in the basin is in a molten state.

14. The method of claim 11, and including the step of withdrawing the heat transfer member from the basin after the metal in the basin has solidified to provide the metal in said basin with a depression.

15. The method of claim 11, and including the step of disposing an evaporable foam pattern in said zone, and contacting said pattern with said molten metal to vaporize said pattern with the vapor being trapped within the interstices of said medium.

* * * * *

UNITED STATES PATENT AND TRADEMARK OFFICE

CERTIFICATE OF CORRECTION

PATENT NO. : 4,858,671

DATED : August 22, 1989

INVENTOR(S) : WILLIAM G. HESTERBERG ET AL

It is certified that error appears in the above-identified patent and that said Letters Patent is hereby corrected as shown below:

Col. 4, Line 43, CLAIM 1, Cancel "transfer-means" and substitute therefor ---transfer means---; Col. 4, line 51 CLAIM 3, Cancel "3" and substitute therefor ---2---

Signed and Sealed this

Ninth Day of April, 1991

*Attest:*

*Attesting Officer*

HARRY F. MANBECK, JR.

*Commissioner of Patents and Trademarks*